US010158165B2

(12) United States Patent
Sledkov et al.

(10) Patent No.: US 10,158,165 B2
(45) Date of Patent: Dec. 18, 2018

(54) BAFFLE BOARD FOR BASE STATION ANTENNA AND BASE STATION ANTENNA ARRAY STRUCTURE

(71) Applicant: Zi-Meng Li, Guangdong (CN)

(72) Inventors: Victor Aleksandrovich Sledkov, Guangzhou (CN); Zi-Meng Li, Dongguan (CN)

(73) Assignee: Zi-Meng Li, Dongguan (CN)

( * ) Notice: Subject to any disclaimer, the term of this patent is extended or adjusted under 35 U.S.C. 154(b) by 58 days.

(21) Appl. No.: 15/507,787

(22) PCT Filed: Sep. 11, 2015

(86) PCT No.: PCT/CN2015/094084

§ 371 (c)(1),
(2) Date: Aug. 14, 2017

(87) PCT Pub. No.: WO2016/074593

PCT Pub. Date: May 19, 2016

(65) Prior Publication Data

US 2017/0358865 A1 Dec. 14, 2017

(30) Foreign Application Priority Data

Nov. 11, 2014 (CN) ..... 2014 1 0630629

(51) Int. Cl.

| | |
|---|---|
| ***H01Q 1/24*** | (2006.01) |
| ***H01Q 21/00*** | (2006.01) |
| ***H01Q 3/32*** | (2006.01) |
| *H01P 1/18* | (2006.01) |
| *H01Q 1/52* | (2006.01) |
| *H01Q 21/08* | (2006.01) |
| *H01Q 25/00* | (2006.01) |

(52) U.S. Cl.

CPC ..... *H01Q 1/246* (2013.01); *H01Q 3/32* (2013.01); *H01Q 21/0006* (2013.01); *H01P 1/184* (2013.01); *H01Q 1/523* (2013.01); *H01Q 1/528* (2013.01); *H01Q 21/08* (2013.01); *H01Q 25/001* (2013.01)

(58) Field of Classification Search

CPC ..... H01Q 1/246; H01Q 3/32; H01Q 3/34; H01Q 21/00; H01Q 21/0006; H01Q 21/0075; H01P 1/184

See application file for complete search history.

(56) References Cited

U.S. PATENT DOCUMENTS

2012/0280882 A1* 11/2012 Zimmerman ..... H01Q 1/42 343/836
2017/0077587 A1* 3/2017 Fleancu ..... H05K 7/20409

* cited by examiner

*Primary Examiner* — Robert Karacsony
(74) *Attorney, Agent, or Firm* — Karthik Murthy; Murthy Patent Law PLLC

(57) ABSTRACT

This application discloses a type of reflecting plate and base station array for base station antennas. The main part of the reflecting plate is mono- or multi-layer reflector chamber, the inside of each layer placed with at least one phase shift cavity, guide groove and projection, the phase shift cavity for holding components of the phase shifter, while guide groove and projection for fixing them, allowing removable dielectric insulation medium of the phase shifter to move within the guide groove. The reflecting plate and the phase shift cavity are designed in integrative structure, achieving good consistency, less soldering and easy installation, costing less time and fewer raw materials, and high efficiency and low cost as well.

10 Claims, 4 Drawing Sheets

BAFFLE BOARD FOR BASE STATION ANTENNA AND BASE STATION ANTENNA ARRAY STRUCTURE

TECHNICAL FIELD

This application relates to base station antenna technology for mobile communications, particularly a type of reflecting plate designed for base station antenna and base station array structure designed for the reflecting plate.

BACKGROUND OF THE TECHNOLOGY

With the rapid development of modern mobile communications, more requirements are raised for base station antennas, particularly for bandwidth characteristics and miniaturization. Downsizing in antennas becomes more demanding due to the great density of networks and public increasing sensitivity towards electromagnetic wave pollution. In addition, such engineering factors as wind resistance and convenience for installation also require reduction in size of antennas.

A base station antenna is made up primarily of reflecting plate, drive mechanism, radiation unit and feed network, the reflecting plate having the ability to improve electromagnetic wave characteristics, particularly beam characteristics, thus being a significant part of the base station antenna playing a major role in forming directional diagram. Generally, the bigger reflecting plate gives better ratio performance but narrower beam width. A base plate of conventional directional antennas is required to be about ¼ wavelength bigger than the radiation device, which means it is rather big in overall size. For example, one kind of reflecting plate is designed with a horizontal tilting plate corresponding to multi-resonant frequencies wherein operating bandwidth is wide and consistency of directional diagram quite satisfactory, which yet results in big-size antenna. The other kind is a horizontal plate relatively small in size, but the antenna is still quite large due to such components as phase shifter and drive mechanism. To a base station antenna, structure of the reflecting plate influences structure of the antenna, similarly, the size determines the size.

In conclusion, many elements affect miniaturization of a base station antenna, such as height of radiation device, structure of phase shifter, drive mechanism, reflecting plate and the whole unit, structure of the reflecting plate particularly. A new type of antenna structure is therefore in pressing need to deal with the issue of miniaturization.

CONTENT OF THE INVENTION

This application aims at providing an improved reflecting plate and the related base station antenna array to solve the problem that the existing reflecting plate cannot meet the needs of dimension reduction, the following technical solution adopted for the purpose. A type of reflecting plate for base station antennas is disclosed in this application, primarily comprising single- or multi-layer reflector chamber, the inside of each layer placed with at least one phase shift cavity, guide groove and projection, the phase shift cavity for holding components of the phase shifter, while guide groove and projection for fixing them, allowing removable dielectric insulation medium of the phase shifter to move within the guide groove.

It should be noted that radiation device of a conventional reflecting plate is arranged on one side of the plate, one or more phase shifters on the other whose installation needs an independent hollow box stabilized on the plate by supporting pillars, resulting in great thickness of the base station antenna array. The drive mechanism of the phase shifter is also positioned on this side higher than the phase shift cavity supporting the plate, further increasing the thickness of the antenna. The reflecting plate in this application differs from the conventional plate mostly in that it is integrated with the phase shift cavity and the drive mechanism to form an integrative cavity structure, the radiation device placed on one side of the plate, the drive mechanism on the same side concealed in the reflector chamber wherein slide dielectric medium of the phase shifter is installed and pulled by a rod, to function beam adjustment of the antenna. No component is on the other side of the reflecting plate, greatly reducing the overall thickness of the antenna. The dimension of the antenna can be reduced partly because of this array structure.

It should also be noted that in order to coordinate the structure claimed in this application and meet the demand of miniaturization, a highly integrated strip line feed network is specially developed to replace the existing base station antenna which uses cables to connect different components and needs many coaxial cables to connect the radiation device with the phase shift, and the phase shift with the phase shift. Consequently, cables of different lengths must be produced and the accuracy must be guaranteed. During installation the correct ones must be picked from the many different cables and soldered to the right positions respectively, quality of welding machine having to be guaranteed as well, the greatest disadvantage of this design lying in that there are two many sorts of cables of different lengths and too many soldering points each of which is uncontrollable during manufacturing process. Each sort of coaxial cable has appropriate bending radius, for example, the common 141 cable has a minimum bending radius of 40 mm. A buffer zone must be planned for the soldering junctions to protect coaxial cables, and minimal bending radius must be planned when winding section lines, which design takes up too much space.

The phase shifter can be placed inside the reflecting chamber and the thickness of the base station antenna can be reduced is crucially because cables are replaced by strip lines occupying less space which together with the phase shifter can be held in the reflector chamber, thus reducing size of the base station antenna. Another advantage of strip lines lies in less welding, easy installation plus fewer solder joints, as well as decreasing intermodulation during production, boosting first pass yield and improving consistency of stationary waves. Besides, wastage rate of strip lines is lower, which benefits the base station antenna array as claimed in this application.

Dimension of the antenna is reduced thanks to the use of a new kind of radiation device whose height and the reflecting plate's is less than 0.15λ in center frequency, while that of a common radiation device is about 0.25λ. The radiation device as claimed in this application can help reduce width of the reflecting plate, for example, a reflecting plate is usually 160 mm in width for a 1695 MHz-2690 MHz base station antenna, but it becomes 120 mm if applying the 0.15λ radiation device. Normally an electrically adjustable base station antenna has cross-sectional area of 90*160 mm=14400 $mm^2$ when working under the 1695-2690 MHz ultra wideband, but it turns 60*120 mm=7200 $mm^2$ in that of this application. Contrast tests show that this antenna which is 50% smaller than a large-size traditional one has equal or improved electrical performance index.

Preferably, both sides of the reflecting plate surface are designed with slender slots parallel and interlinked to all layers of the guide groove for easy connection between the phase shifter and the related drive mechanism.

Preferably, fastener holes are designed on the reflecting plate surface to fixedly connect the radiation device.

Preferably, each layer of the chamber on both sides of the central axis of the reflecting plate contains symmetrical square cavities extending along the length of the plate, parallel to the guide grooves and for handling input and output ports of the phase shifter. Correspondingly the plate surface has rectangular orifices for feed cables to pass through and metal side walls between for isolating polarizations and restraining mutual coupling.

This application also discloses a type of base station antenna array comprising the reflecting plate, adapter plate, radiation device, phase shifter and drive mechanism as claimed in this application, the adapter plate fixed on one end of the reflecting plate in an integrative structure; the radiation device placed on the plate surface; the phase shifter placed in the phase shift cavity, fixed by the guide groove and projection; the drive mechanism placed on the reflecting plate surface, its sliding would guide the phase shifter to move within the guide groove.

Preferably, the drive mechanism consists of drive shaft support, drive shaft and rotating plate, the drive shaft fixed on the reflecting plate surface, one end fixed on the drive shaft support, the other end on the adapter plate, the rotating carriage connected to the drive shaft along which it can move. Specifically, the drive shaft support is embedded in the reflector chamber, the drive shaft implanted in the reflecting plate, one end fixed on the drive shaft support, the other end on the adapter plate, the rotating carriage connected to the drive shaft along which it can exploit a reciprocating motion, and designed with two pillars on both ends to drag the dielectric components of the phase shifter.

Preferably, both ends of the rotating plate are fixedly connected to the phase shifter located in the reflector chamber through the slender slot placed on the reflecting plate surface.

Preferably, a nonmetallic dielectric film is placed between the radiation device and the reflecting plate surface to avoid passive intermodulation.

The phase shifter consists of slide dielectric block, dielectric slot, rod, dielectric substrate and metal strip lines, the rod placed in the guide groove, the slide dielectric block connected to the dielectric slot embedded in the projection, convenient for the rod to pull the phase shifter to glide accurately within the guide groove. The dielectric substrate is fixed on the phase shift cavity to support the metal strip lines Preferably, plus end closure and joints fixedly connected on the adaptor plate.

Benefit of this application: the phase shift cavity and the reflecting plate as claimed in this application are designed in an integrative structure, having good consistency, less welding and simple assembly, costing less time and fewer raw materials, thus achieving high efficiency and low cost, simplifying the production of antennas.

A new type of antenna array is presented in this application wherein the phase shifter cavity and the reflecting plate are of an integrative structure to decrease components and soldering, thus with easy installation, high efficiency and low cost. The antenna can be reduced by ⅓ in thickness, for example, a common 1695-2690 MHz antenna is 90 mm, while that claimed in this application is 60 mm, or even 45 mm.

The highly integrated beamforming network designed with no cables in this application wherein feed network among the array elements for connecting the antenna arrays has no cables but strip lines integrating in the feed network, with fewer soldering points than any other base station antennas, directivity index of the antenna has good consistency, enhanced manufacturability, and fewer soldering points to reduce chance of affecting antenna intermodulation. Existing designs utilize large numbers of coaxial cables causing too many soldering points and too much instability.

Feed network of electrically adjustable antenna is complicated, so existing base station antenna companies utilize large numbers of coaxial cables in antenna designs, which cause too many soldering points and too complicated antenna arrangement, requiring large numbers of workers during the antenna production, leaving great difficulty to realize automation. The product as claimed in this application is highly integrated, therefore the entire production process can be automated, all soldering and installing jobs finished completely by robots. The outcome is production efficiency would be raised by over 5 times compared with that of traditional antenna companies. Owing to the high integration characteristics, consistency of the antennas produced is enhanced and rejection ratio is decreased.

DETAILED DESCRIPTION OF EMBODIMENTS

Figure 1:
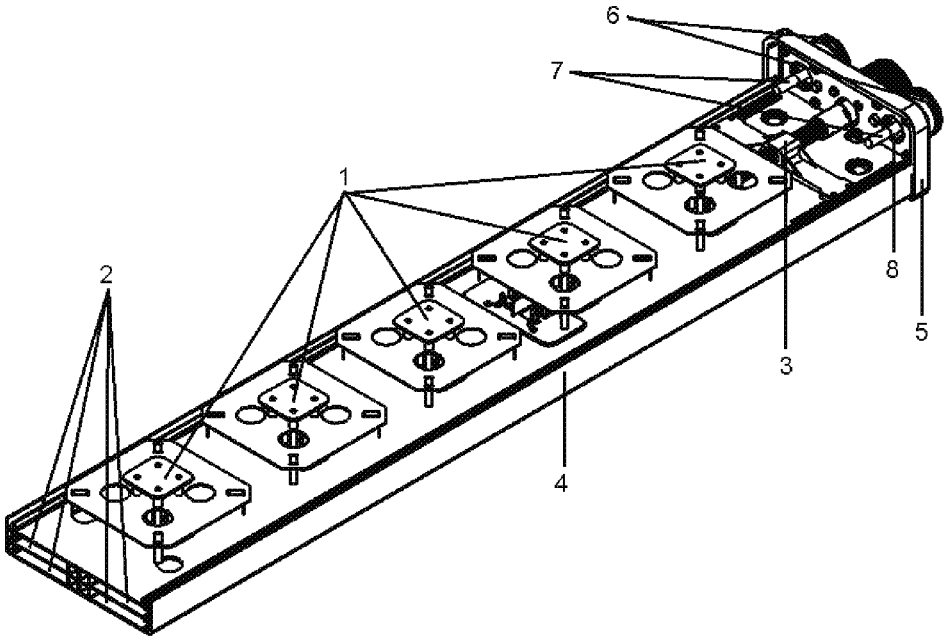
FIG. 1 illustrates the base station antenna array according to one embodiment of this application, comprising a group of radiation devices, phase shifter, drive mechanism, reflecting plate, end closure and joints.

The reflecting plate and related elements of the new base station antenna array includes the integrative mono- or multi-layer reflector chambers, wherein the phase shifter plus the guide groove and projection are settled to guide and limit the corresponding components of the phase shifter. The radiation device is settled on central axis of the reflecting plate surface, pedestal of the radiation device equipped with holes, the corresponding reflecting plate also equipped with holes. Each radiation device is fixedly fastened on the reflecting plate surface by several rivets or fasteners. Similarly, there are holes on the phase shifter corresponding to the reflecting plate surface and the pedestal of the radiation device, so when fastening the radiation device, the phase shifter is fastened at the same time. The phase shift cavity is in an integrative structure with the reflecting plate surface on which single pair or double pair of edges is employed, each pair of edges parallel to each other and corresponding to the two edges symmetrically positioned along the central axis. A slender slot is configured nearby parallel to the edge of the reflecting plate surface. The shift phase drive mechanism on the reflecting plate would lead, via a thread screw, the slide carriage which is connected to the phase shift components by fasteners to exploit straightline reciprocating motion in the slender slot. The phase shifter can adjust the beams in the vertical plane when the slide carriage is exploiting straightline reciprocating motion. There are symmetrical square cavities on both sides of the reflecting plate central axis. There are rectangular orifices on the reflecting plate, under the radiation device, to connect the radiation device feed cable to the input port of the phase shifter. There is metal side wall between the rectangular orifices for the purpose of isolating polarizations and restraining mutual coupling. The input connector is positioned at bottom of the antenna and securely fixed on the adaptor plate which is securely fixed on the reflecting plate and connects antenna stand by fasteners. The reflecting plate surface is designed with signal input ports to which coaxial cables of the joint are soldered. In addition, a shield plate is designed among the radiation device to restrain mutual coupling.

The reflecting plate and the phase shift cavity are of an integrative structure, by metal extrusion, or non-metallic material pultrusion and plating metal on the surface afterwards, or by 3D printing. The reflector chamber can be composed of single-, double- or multi-layer cavities, and can be composed of overlying single-layer cavities by riveting or soldering. The reflecting plate structure comprises a traditional single-layer reflecting plate overlaying with single- or multi-layer phase shift cavity by means of riveting or soldering, each cavity divided into several sub-cavities in accordance with the design. The reflecting chamber is positioned with guide groove and projection. There are symmetrical small cavities on both sides of the reflecting plate central axis. The reflecting plate surface has side edge, and one end of the reflecting plate surface is designed with slender groove.

The feed network is of non-cable, the drive mechanism settled on the reflector surface, the joint input cable on the reflector surface and the input port on the reflector surface. The input port has input conductor, between which and the reflecting plate is settled with a nonmetallic dielectric film, and among the input ports is settled with metal isolation plate. The radiation device is fixedly settled on the reflecting plate, between the pedestal of the radiation device and the reflecting plate is equipped with a nonmetallic dielectric film, among the radiation device is equipped with metal isolation plate which is fixedly settled on the reflecting plate, and between the metal isolation plate and the reflecting plate is equipped with a nonmetallic dielectric film. The isolation plate can be made of a nonmetallic film coated with metal. There are holes on the reflecting plate under the pedestal of the radiation device, and among the holes are metal side walls. The height of the radiation device and the reflecting surface is less than 0.15λ in center frequency. Top of the radiation device is conductor sheet supported by insulation medium, around it are even-distributed conductor bars.

The following embodiments in combination with the figures are provided to assist in further stating this application. The following embodiments are used merely for understanding and stating this application, but should not be interpreted as a limitation to this application.

Embodiment One

The base station antenna array structure is shown in FIGS. 1-4, as shown in FIG. 1, comprising a group of radiation devices 1, phase shifters 2, a drive mechanism 3, a reflecting plate 4, an end closure 5, joints 6, cables 7, an adaptor plate 8. The reflecting plate 4 is smaller than existing antenna reflecting plates. As can be seen from the FIGS, the reflecting plate 4 is designed to be an integrative structure of double-layer cavity, inside each of which is positioned with a phase shifter 2 whose design responds to the cavity. The group of radiation devices 1 is fixedly positioned on the reflecting plate by fasteners 11. The drive mechanism 3 is positioned on the antenna reflecting plate surface in order to save space of the back of the antenna and reduce the thickness of the antenna as a result. The adaptor plate 8, made from die-cast zinc-aluminum alloys, is positioned inside the cavity and fixedly positioned on the reflecting plate by fasteners 8*a* which connect a bracket for installing and adjusting. The end closure 5 and the joints 6 are fixedly positioned on the adaptor plate 8, and one end of each of the cable 7 is soldered to the joint, the other end soldered to the input port of the antenna, and cables 7 are on the reflecting plate.

Figure 2:
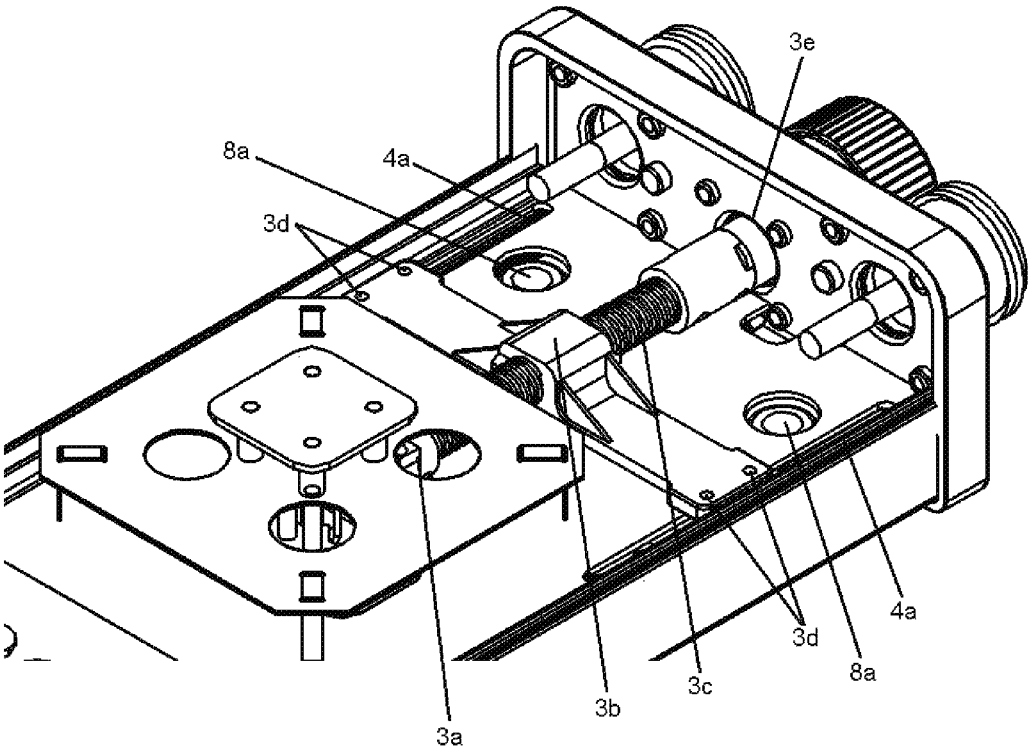
FIG. 2 illustrates specifics of the bottom structure of the base station antenna array according to the embodiment of this application, mainly comprising a group of radiation devices, phase shifter, drive mechanism, reflecting plate, end closure and joints.

FIG. 2 shows bottom of the base station antenna array structure, comprising the whole drive mechanism 3, end closure 5, joints 6, cables 7 and adaptor plate 8. Drive mechanism 3 is positioned on the reflecting plate surface, drive shaft support 3*a* holding one end of drive shaft 3*b* on reflecting plate 4, the other end passing through adaptor plate 8 and concentric hole 3*e* on end closure 5, and being concentric with them. Rotating carriage 3*c* is in cooperation with drive shaft 3*b*. There are small holes 3*d* on both ends of rotating carriage 3*c*, and on the reflecting plate near the ends of rotating carriage 3*c* there are slender grooves 4*a* which are parallel to the central axis of the reflecting plate. Center of small hole 3*d* coincide with center of the slender groove, and the hole on the phase shifter slide screw coincide with the center of small hole 3*d* and center of slender groove 4*a*, so that rotating carriage 3*c* can correlates with the phase shifter by just using fasteners. When rotating carriage 3*c* moves back and forth in slender groove 4*a*, phase shifter 2 can adjust the slanting angle of the directivity diagram related to the vertical plane of the antenna.

Figure 3:
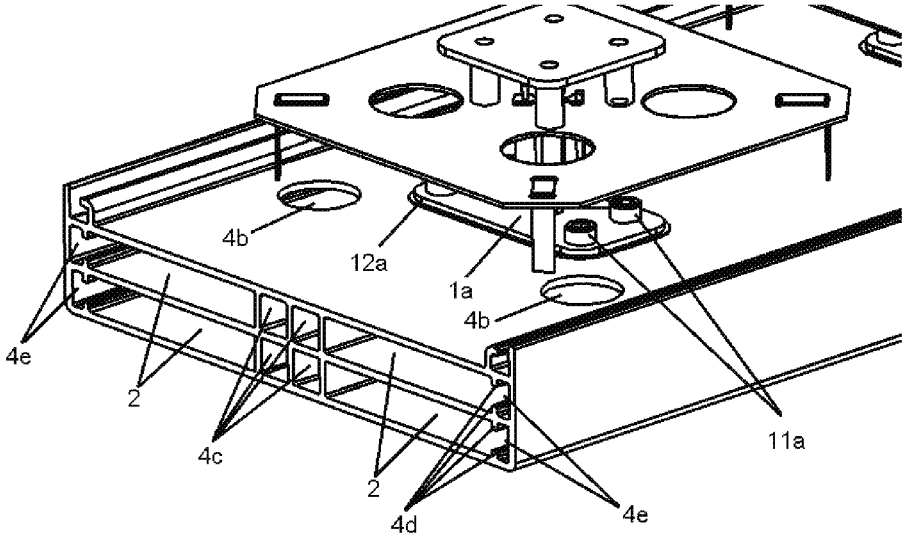
FIG. 3 illustrates specifics of top structure of the base station antenna array according to the embodiment of this application, comprising a reflecting plate, phase shift cavity, installation.

FIG. 3 shows top of the base station antenna array structure, comprising the radiation device 1, phase shifter 2 and reflecting plate 4 which is of double-layer cavity. 4*e* is the guide groove of the reflecting plate, and 4*d* is projection. The slide bar in phase shifter 2 would slide in guide groove 4*e* and projection 4*d*. Guide groove 4*e* guides in the vertical direction and projection 4*d* limits space in the horizontal direction. Square cavities 4*c* are distributed on both sides along the central axis of the reflecting plate, and are where the input port of the phase shifter is positioned, and restrain mutual coupling. Holes 4*b* are fastener holes, through which adjusting bracket of the antenna can be fixedly positioned. Fasteners 11*a* help to fix radiation device 1 onto reflecting plate 4, between which and pedestal 1*a* of the radiation device is planned with a nonmetallic dielectric film 12*a* which can prevent passive intermodulation.

Figure 4:
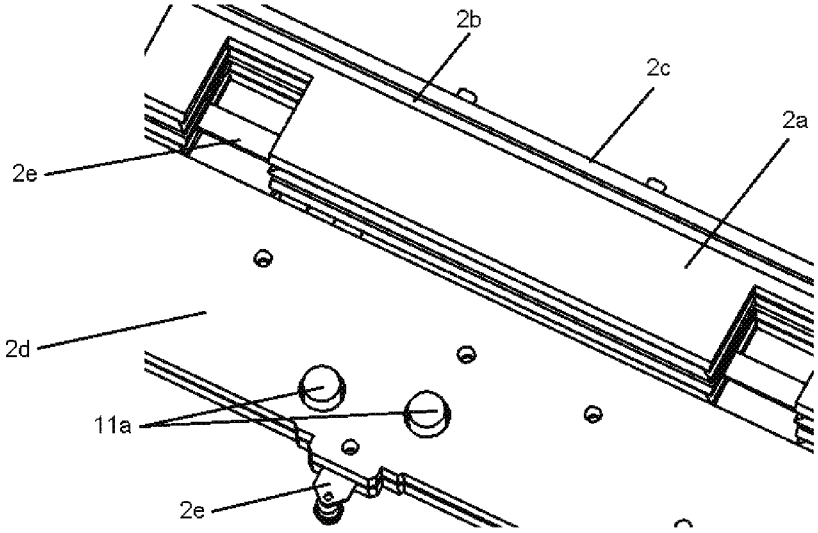
FIG. 4 illustrates specifics related to the interior of the phase shifter of the base station antenna array according to the embodiment of this application, comprising a dielectric block and strip lines.

FIG. 4 shows the internal part of phase shifter 2 of the base station antenna, comprising slide dielectric block 2*a*, throttle 2*c*, dielectric block guide groove 2*b*, dielectric substrate 2*d*, metal strip line 2*e*. Throttle 2*c* is positioned in guide groove 4*e* of the reflecting plate, and projection 4*d* is positioned in dielectric block guide groove 2*b*, so that the slide bar of the phase shifter can slide back and forth accurately. Dielectric medium 2*d* supports metal strip line 2*e*, and fasteners 11*a* fixedly holds dielectric substrate 2*d*.

Embodiment Two

Figure 5:
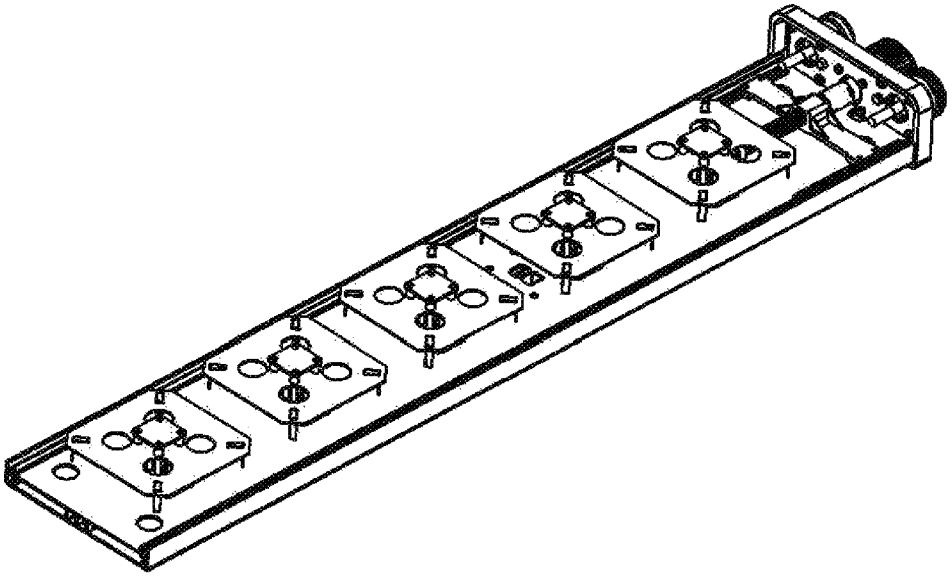
FIG. 5 illustrates the base station antenna array according to another embodiment of this application, comprising a monolayer reflecting plate, a phase shifter, a drive mechanism, a reflecting plate, end closure and joints.

The base station antenna array as claimed in this application as shown in FIG. 5, adopting single-layer cavity structure. Other designs are exactly the same with that illustrated in embodiment one, so the description will not be repeated again here.

In this embodiment, the antenna would be smaller in size due to the utilization of single-layer cavity structure.

Embodiment Three

Figure 6:
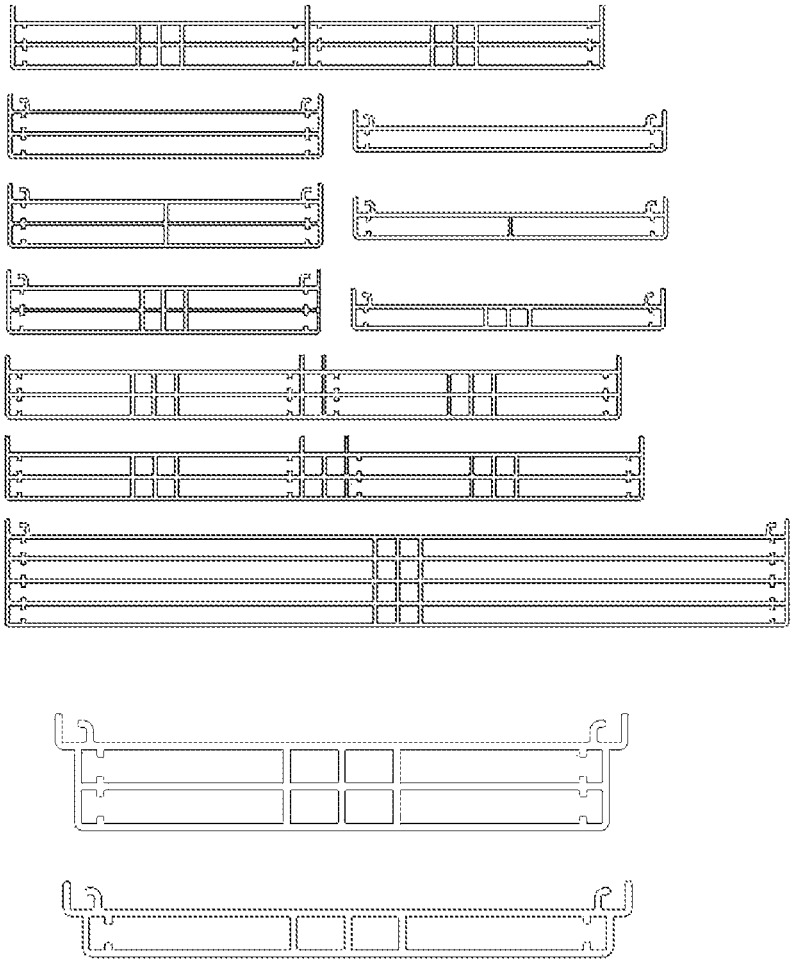
FIG. 6 illustrates variants of the reflecting plate in this application.

This is a further study on the reflecting plate structure based on embodiment one and two, and the result reflects, as FIG. 6, the reflecting plate can be designed as single-, double- or multilayer structure according to different needs. Projection can be positioned on the reflecting plate surface in accordance with the installation of the drive mechanism to help the drive mechanism to slide accurately.

Respecting to the reflecting plate and the corresponding base station antenna array structure as claimed in this application, the phase shift cavity is designed to be an integrative structure with the reflecting plate, characterized in good consistency, few soldering, easy installing, high efficiency, and costing fewer raw materials, thus low-cost. In addition, in the base station antenna array structure, the adaptor plate is designed to be an integrative structure with the reflecting plate, which also decrease soldering points and is easy to assemble. This technology can be used to antennas of any other frequency, therefore the above is just a preferred implementation of this application, imposing no restrictions to the technical range related to this application. Technical personnel in this field can make some modifications inspired by this technical proposal. Any modification or equivalent change to the above embodiments according to the essence of this technology is within this claimed technical proposal.

The invention claimed is:

1. A reflecting plate for base station antennas characterized in that its main body is single- or multi-layer reflector chamber, the inside of each comprising at least one phase shift cavity in an integrative structure with the reflecting plate, each layer of the reflector chamber for holding its related components is placed with guide groove and projection designed to fasten and limit the phase shift components, enabling a removable dielectric insulation medium to move within the guide groove.

2. The reflecting plate of claim 1, wherein both sides of the plate surface are placed with slender grooves parallel and connected to the guide groove for easy connection between a phase shifter and a related drive mechanism.

3. The reflecting plate of claim 1 wherein fastener holes are designed on the reflecting plate surface to fixedly connect a radiation device and fasten a phase shifter substrate at the same time.

4. The reflecting plate of claim 1 wherein each layer of the chamber on both sides of the central axis of the reflecting plate contains symmetrical square cavities extending along the length of the plate, parallel to the guide grooves and for handling input and output ports of a phase shifter, correspondingly the plate surface has rectangular orifices for feed cables to pass through and metal side walls between for isolating polarizations and restraining mutual coupling.

5. A type of base station antenna array comprising the reflecting plate according to claims 1 to 4, adapter plate, radiation device, phase shifter and drive mechanism, the adapter plate fixed on one end of the reflecting plate in an integrative structure; the radiation device placed on the plate surface; the phase shifter placed in the phase shift cavity, fixed by the guide groove and projection; the drive mechanism placed on the reflecting plate surface, its sliding would guide the phase shifter to move within the guide groove.

6. The base station antenna array of claim 5 wherein the drive mechanism consists of drive shaft support, drive shaft and rotating plate, the drive shaft support embedded in the reflector chamber, the drive shaft implanted in the reflecting plate, one end fixed on the drive shaft support, the other end on the adapter plate, the rotating carriage connected to the drive shaft along which it can exploit a reciprocating motion, and designed with two pillars on both ends to drag the dielectric components of the phase shifter.

7. The base station antenna array of claim 6 wherein both ends of the rotating plate are fixedly connected to the phase shifter inside the reflecting chamber via a slender slot on the reflecting plate surface.

8. The base station antenna array of claim 5 wherein a nonmetallic dielectric film is placed between the radiation device and the reflecting plate surface to avoid passive intermodulation.

9. The base station antenna array of claim 5 wherein the antenna reflecting plate and the phase shift cavity are formed in an integrative structure.

10. The base station antenna array of claim 5 wherein the phase shifter consists, of slide dielectric block, dielectric slot, rod, dielectric substrate and metal strip lines, the rod placed in the guide groove, the slide dielectric block connected to the dielectric slot embedded in the projection, convenient for the rod to pull the phase shifter to glide accurately within the guide groove, the dielectric substrate is fixed on the phase shift cavity to support the metal strip lines.

* * * * *